US006164722A

United States Patent [19]

Mabey

[11] Patent Number: 6,164,722

[45] Date of Patent: Dec. 26, 2000

[54] ROTATING SHOWER SEAT

[76] Inventor: Karen Mabey, 750 E. Claraday St. #13, Glendora, Calif. 91740

[21] Appl. No.: 09/322,341

[22] Filed: May 28, 1999

[51] Int. Cl.[7] ..... A47C 1/02

[52] U.S. Cl. ..... 297/344.22; 297/183.9; 4/578.1

[58] Field of Search ..... 297/183.9, 344.22, 297/344.26, 137; 4/578.1, 579; 248/418

[56] References Cited

U.S. PATENT DOCUMENTS

| | | | |
|---|---|---|---|
| 4,120,531 | 10/1978 | Fefferman | 297/344.22 |
| 4,518,139 | 5/1985 | Barfell | 297/344.22 X |
| 5,733,006 | 3/1998 | Woods | 297/344.22 |
| 5,822,809 | 10/1998 | Gallo | 4/578.1 |
| 5,903,935 | 5/1999 | Huelke | 4/578.1 |
| 5,953,769 | 9/1999 | Williams | 4/578.1 |

*Primary Examiner*—Peter R. Brown
*Attorney, Agent, or Firm*—Goldstein & Canino

[57] ABSTRACT

A rotating shower seat including a base member having a generally circular plate secured thereto. The circular plate has a plurality of radially disposed notches extending inwardly of a peripheral side edge thereof. A circular seat is rotatably coupled with the circular plate of the base member. The circular seat has a pivot rod extending downwardly therefrom and coupling with the circular plate. A lower surface of the circular seat has a circular bearing disposed therein to facilitate rotation of the circular seat with respect to the circular plate. A pair of handles are secured to the circular seat. A spring biased locking member selectively engages one of the notches of the circular plate.

2 Claims, 2 Drawing Sheets

ROTATING SHOWER SEAT

BACKGROUND OF THE INVENTION

The present invention relates to a rotating shower seat and more particularly pertains to assisting persons who are unable to stand in taking a shower with a rotating shower seat.

Many accidents occur in the use of bathtubs and showers, and particularly when these installations are utilized by persons who are elderly or somewhat incapacitated. Standing within a shower stall or in a bathtub while taking a shower is often a trying and sometimes impossible task. Many devices today provide means to allow a person of limited dexterity to gain access to a bathtub. However, these devices do not help the person once they are positioned within the bathtub or shower. A device is needed that will effectively support a person in a comfortable seated positioned while showering. This device should allow the person the ability to freely rotate their body while sitting to enable a proper washing of their entire body. Additionally, means needs to be provided to assist the person in standing up once finished showering. Such a device would constitute a significant improvement in the art in that many advantages would be realized as enumerated hereafter.

The use of shower chairs is known in the prior art. More specifically, shower chairs heretofore devised and utilized for the purpose of facilitating the use of a shower and assisting persons in bathroom facilities are known to consist basically of familiar, expected and obvious structural configurations, notwithstanding the myriad of designs encompassed by the crowded prior art which have been developed for the fulfillment of countless objectives and requirements.

By way of example, U.S. Pat. No, 4,628,550 to Walton discloses a bathroom shower chair with means to swing in and out of the shower or bathtub, however, it appears to be anchored to the side walls of the stall. U.S. Pat. No. 5,606,751 to Baker discloses a shower chair and transfer device that rests on the top of the sides of a bathtub. U.S. Pat. No. Des. 355,985 to Karten discloses the ornamental design for a shower chair.

While these devices fulfill their respective, particular objective and requirements, the aforementioned patents do not describe a rotating shower seat for assisting persons who are unable to stand in taking a shower.

In this respect, the rotating shower seat according to the present invention substantially departs from the conventional concepts and designs of the prior art, and in doing so provides an apparatus primarily developed for the purpose of assisting persons who are unable to stand in taking a shower.

Therefore, it can be appreciated that there exists a continuing need for new and improved rotating shower seat which can be used for assisting persons who are unable to stand in taking a shower. In this regard, the present invention substantially fulfills this need.

SUMMARY OF THE INVENTION

In the view of the foregoing disadvantages inherent in the known types of shower chairs now present in the prior art, the present invention provides an improved rotating shower seat. As such, the general purpose of the present invention, which will be described subsequently in greater detail, is to provide a new and improved rotating shower seat and method which has all the advantages of the prior art and none of the disadvantages.

To attain this, the present invention essentially comprises a base member comprised of two pairs of angularly disposed legs having a pair of crossing members extending therebetween disposed between upper and lower ends thereof. The upper ends of the legs have a generally circular plate secured thereto. The circular plate has a central support rod extending downwardly therefrom. The circular plate has four radially disposed notches extending inwardly of a peripheral side edge thereof. A circular seat is rotatably coupled with the circular plate of the base member. The circular seat had a pivot rod extending downwardly therefrom and coupling with the circular plate. A lower surface of the circular seat has a circular bearing disposed therein to facilitate rotation of the circular seat with respect to the circular plate. A pair of handles are secured to the circular seat. The pair of handles each have an inverted U-shaped configuration defined by an upper horizontal portion and a pair of downwardly extending vertical members of the horizontal portion. Free lower ends of the vertical members secure to the circular seat. A spring biased locking member selectively engages one of the notches of the circular plate. The locking member has an inverted L-shaped configuration defined by an elongated horizontal member and a short upwardly extending vertical member depending from an outer end of the horizontal member. The vertical member has a spring secured thereto. An inner end of the spring is secured to a fixed block member. The spring biases the locking member inwardly for engagement with one of the notches.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved rotating shower seat which has all the advantages of the prior art shower chairs and none of the disadvantages.

It is another object of the present invention to provide a new and improved rotating shower seat which may be easily and efficiently manufactured and marketed.

It is a further object of the present invention to provide a new and improved rotating shower seat which is of durable and reliable construction.

An even further object of the present invention is to provide a new and improved rotating shower seat which is susceptible of a low cost of manufacture with regard to both materials and labor, and which accordingly is then susceptible of low prices of sale to the consuming public, thereby making such a rotating shower seat economically available to the buying public.

Even still another object of the present invention is to provide a new and improved rotating shower seat for assisting persons who are unable to stand in taking a shower.

Lastly, it is an object of the present invention to provide a new and improved rotating shower seat including a base member having a generally circular plate secured thereto. The circular plate has a plurality of radially disposed notches extending inwardly of a peripheral side edge thereof. A circular seat is rotatably coupled with the circular plate of the base member. The circular seat had a pivot rod extending downwardly therefrom and coupling with the circular plate. A lower surface of the circular seat has a circular bearing disposed therein to facilitate rotation of the circular seat with respect to the circular plate. A pair of handles are secured to the circular seat. A spring biased locking member selectively engages the notches of the circular seat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there is illustrated preferred embodiments of the invention.

BRIEF DESCRIPTION OF THE DRAWING

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
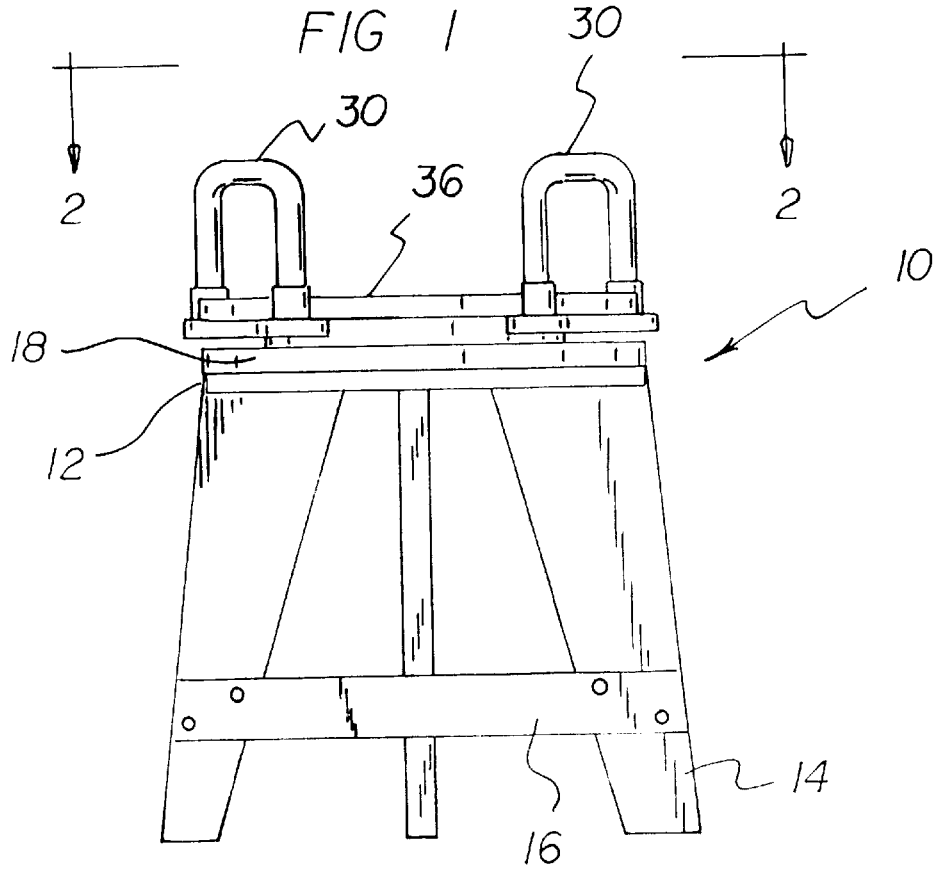
FIG. 1 is a rear view of the preferred embodiment of the rotating shower seat constructed in accordance with the principle of the present invention.
Figure 2:
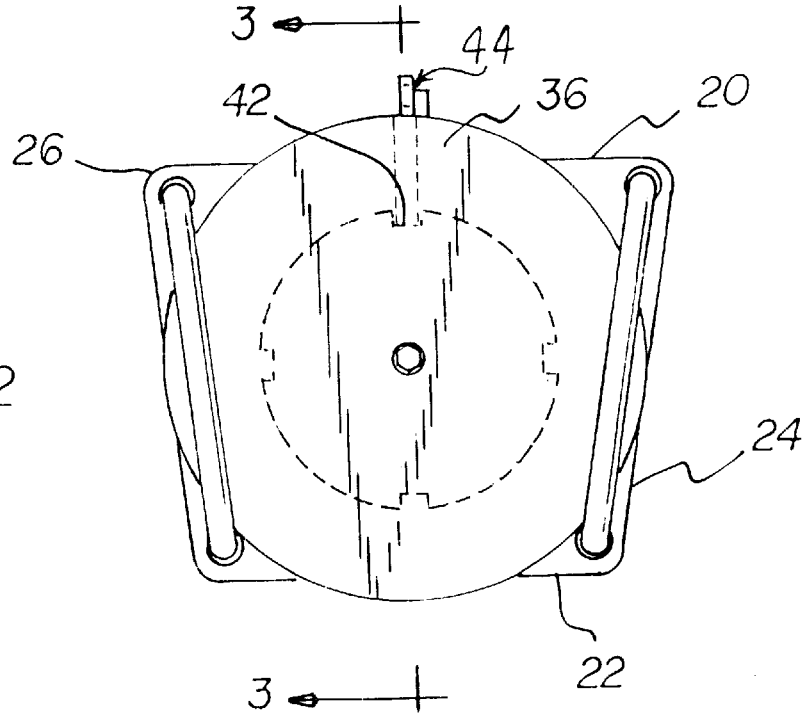
FIG. 2 is a top plan view of the present invention as taken along line 2—2 of Figure.
Figure 3:
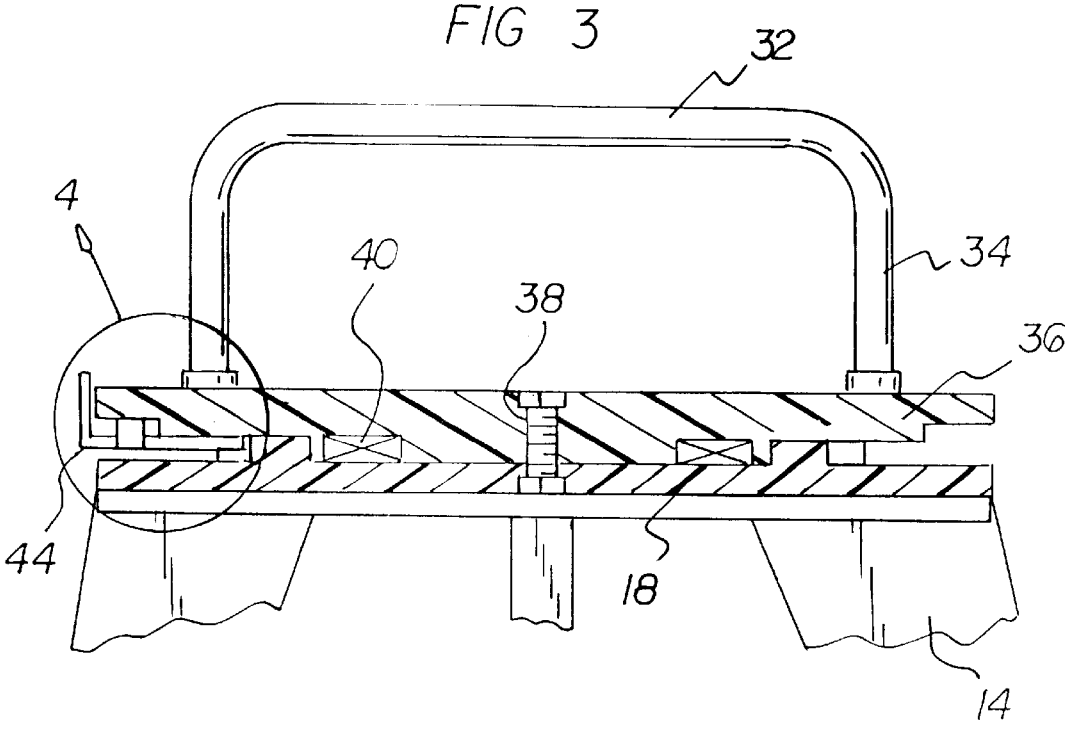
FIG. 3 is a cross-sectional view of the present invention as taken along line 3—3 of FIG. 2.
Figure 4:
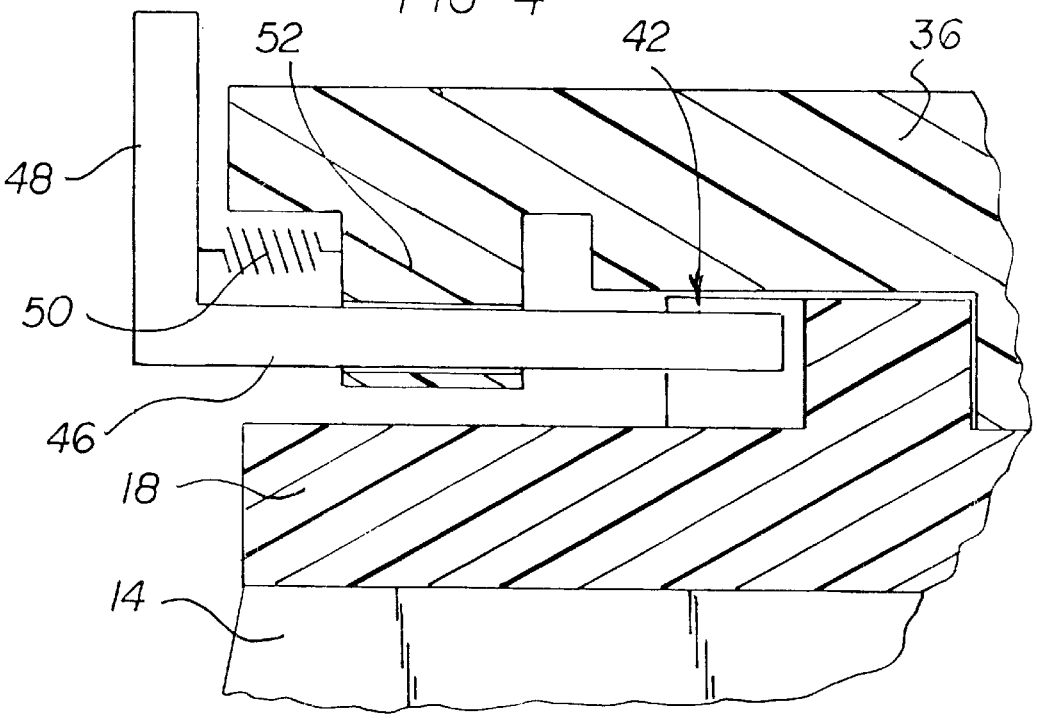
FIG. 4 is an enlarged sectional view of the present invention as taken from circle 4 of FIG. 3.

With reference now to the drawings, and in particular, to FIGS. 1 through 4 thereof, the preferred embodiment of the new and improved rotating shower seat embodying the principles and concepts of the present invention and generally designated by the reference number 10 will be described.

Specifically, it will be noted in the various Figures that the device relates to a rotating shower seat for assisting persons who are unable to stand in taking a shower. In its broadest context, the device consists of a base member, a pair of handles, a circular seat, and a spring biased locking member. Such components are individually configured and correlated with respect to each other so as to attain the desired objective.

The base member 12 is comprised of two pairs of angularly disposed legs 14 having a pair of crossing members 16 extending therebetween disposed between upper and lower ends thereof. The upper ends of the legs 14 have a generally circular plate 18 secured thereto. The circular plate 18 has four radially disposed notches 42 extending inwardly of a peripheral side edge thereof.

The circular seat 36 is rotatably coupled with the circular plate 18 of the base member 12. The circular seat 36 has a pivot rod 38 extending downwardly therefrom and coupling with the circular plate 18. A lower surface of the circular seat 36 has a circular bearing 40 disposed therein to facilitate rotation of the circular seat 36 with respect to the circular plate 18.

The pair of handles 30 are secured to the circular seat 36. The pair of handles 30 each have an inverted U-shaped configuration defined by an upper horizontal portion 32 and a pair of down wardly extending vertical members 34 depending from opposite ends of the horizontal portion 32. Free lower ends of the vertical members 34 secure to outwardly extending plates disposed on the lower surface of the circular seat 36. The handles 30 are situated on the seat 36 at an angle in order to provide easier access at the front of said seat 36. Note FIG. 2.

The spring biased locking member 44, located at the front of the circular seat 36, selectively engages the notches 42 of the circular plate 18. The locking member 44 has an inverted L-shaped configuration defined by an elongated horizontal member 46 and a short upwardly extending vertical member 48 depending from an outer end of the horizontal member. The vertical member 48 has a spring 50 secured thereto. An inner end of the spring 50 is secured to a fixed block member 52 extending downwardly from the circular seat 36. The spring 50 biases the locking member 44 inwardly through the fixed block member 52 for engagement with one of the notches 42. The notches 42 are disposed at ninety degree intervals around the perimeter of the circular plate 18. The user simply pulls outwardly on the locking member 44 in order to allow for the rotation of the circular seat 36.

As to the manner of usage and operation of the present Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A rotating shower seat for assisting persons who are unable to stand in taking a shower comprising, in combination:

a base member comprised of two pairs of angularly disposed legs having a pair of crossing members extending therebetween disposed between upper and lower ends thereof, the upper ends of the legs having a generally circular plate secured thereto, the circular plate having a central support rod extending downwardly therefrom, the circular plate having four radially disposed notches extending inwardly of a peripheral side edge thereof, the notches being disposed at ninety degree intervals;

a circular seat rotatably coupled with the circular plate of the base member, the circular seat having a pivot rod extending downwardly therefrom and coupling with the circular plate, a lower surface of the circular seat having a circular bearing disposed therein to facilitate rotation of the circular seat with respect to the circular plate;

a pair of handles secured to the circular seat, the pair of handles each having an inverted U-shaped configuration defined by an upper horizontal portion and a pair of downwardly extending vertical members depending from opposite ends of the horizontal portion, free lower ends of the vertical members securing to outwardly extending plates disposed on the lower surface of the circular seat;

a spring biased locking member selectively engaging the notches of the circular plate, the locking member having an inverted L-shaped configuration defined by an elongated horizontal member and a short upwardly extending vertical member depending from an outer end of the horizontal member, the vertical member having a spring secured thereto, an inner end of the spring securing to a fixed block member extending downwardly from the lower surface of the circular seat, the spring biasing the locking member inwardly through the fixed block member for engagement with one of the notches.

2. A rotating shower seat for assisting persons who are unable to stand in taking a shower comprising, in combination:

a base member having a generally circular plate secured thereto, the circular plate having a plurality of radially disposed notches extending inwardly of a peripheral side edge thereof;

a circular seat rotatably coupled with the circular plate of the base member, the circular seat having a pivot rod extending downwardly therefrom and coupling with the circular plate, a lower surface of the circular seat having a circular bearing disposed therein to facilitate rotation of the circular seat with respect to the circular plate;

a pair of handles secured to the circular seat;

a spring biased locking member selectively engaging one of the notches of the circular plate, said locking member having an inverted L-shaped configuration defined by an elongated horizontal member and a short upwardly extending vertical member depending from an outer end of the horizontal member, the vertical member having a spring secured thereto, an inner end of the spring securing to a fixed block member of the circular seat, the spring biasing the locking member inwardly through the fixed block member for engagement with one of the notches.

* * * * *